United States Patent [19]

Schacht

[11] Patent Number: 4,523,865

[45] Date of Patent: Jun. 18, 1985

[54] MARKING AND ENGRAVING MACHINE

[76] Inventor: Roy A. Schacht, 744 Des Peres Rd., St. Louis, Mo. 63131

[21] Appl. No.: 525,960

[22] Filed: Aug. 24, 1983

[51] Int. Cl.[3] ..... B41J 3/38; B41J 1/54

[52] U.S. Cl. ..... 400/18; 400/31; 400/134.1; 400/612; 30/164.9; 33/1 M; 33/18 R

[58] Field of Search ..... 400/18, 19, 20, 31, 400/134, 134.1, 612; 33/1 M, 18 R, 18 B; 30/164.9; 346/130, 134, 139 R, 139 A; 409/79

[56] References Cited

U.S. PATENT DOCUMENTS

| | | | |
|---|---|---|---|
| 4271 | 11/1845 | Thurber | 400/19 |
| 119,537 | 10/1871 | Shiland | 400/134 |
| 2,213,831 | 9/1940 | Bates | 400/134 |
| 2,664,985 | 1/1954 | Schacht | 400/134.1 |
| 2,814,546 | 11/1957 | Nickel | 346/134 X |
| 3,063,311 | 11/1962 | Beckwith et al. | 409/79 X |
| 3,173,210 | 3/1965 | Allemann | 409/79 |
| 3,921,781 | 11/1975 | Corte | 400/134.5 |
| 4,171,657 | 10/1979 | Halberschmidt et al. | 33/1 M X |
| 4,254,552 | 3/1981 | Samis | 33/18 R |
| 4,351,111 | 9/1982 | Carr | 30/164.9 |

*Primary Examiner*—Clifford D. Crowder

*Attorney, Agent, or Firm*—Glenn K. Robbins

[57] ABSTRACT

A marking machine for marking and engraving upon a work surface. The machine comprises a rotary marking wheel having marking characters upon the periphery of the wheel and an engraving tool or stylus. The engraving tool may be employed as part of the printing wheel or as a separate attachment providing one or more different types of engraving tool. The engraving tool may be employed for scratch engraving or rotary power may be used for a printed sharp edge cutting and engraving. A work surface such as a tag or the like is supported upon a worktable formed of an upper table member carried upon a lower table member. Separate motor means are provided for each of the table members for moving the upper table toward both the front and rear of the lower table laterally to provide a simultaneous X-Y movement. The marking of the work surface may be carried out for use with marking characters with the marking wheel stopped while the worktable is raised into engagement with the marking wheel and for engraving when the marking wheel or separate stylus is registered with the raised worktable and the upper and lower table members are simultaneously moved in an X-Y fashion to provide an engraved design in any desired configuration.

20 Claims, 15 Drawing Figures

MARKING AND ENGRAVING MACHINE

BACKGROUND OF THE INVENTION

In the past various types of marking machines have been devised for imprinting on metal or plastic workpieces such as nameplates, tags or the like. Marking machines utilizing rotary imprinting wheels in which the characters appear on the periphery of the wheel and are caused to print against a workpiece raised into printing relationship by a vertical reciprocating worktable are shown in my U.S. Pat. Nos. 2,664,985; 3,785,470; 4,229,111 and 4,322,173. The continuously rotating printing wheel is stopped in the printing operation as the worktable is raised.

Such machines generally provide an escapement mechanism using a toothed feed bar with pawls engageable to advance the worktable from one character printing position to another. Such mechanisms are complex in nature and are not easily adjusted to provide for variable spacing over a wide range and movement of the worktable in slight degree and have no provisions for engraving such as by stylus or the like and marking is restricted to the marking characters provided on the periphery of the marking wheel.

SUMMARY OF THE INVENTION

By means of this invention there has been provided a marking and engraving machine in which a marking wheel is provided with the usual marking characters on the periphery of a marking wheel and a stylus at one or more positions on the wheel which can be employed for engraving a workpiece supported on a worktable underlying the wheel. A separate stylus with one or a multiplicity of styluses or a rotary cutting and engraving device may also be employed in lieu of the marking or printing wheel. The worktable supporting the workpiece to be marked by the printing wheel, separate stylus or the like may be moved toward the front or rear and in traversing direction to the left or right of the machine simultaneously or sequentially as desired through a wide range of movement. The degree of movement may be varied from a very slight degree in the order of a thousandth of an inch upwardly to the limit of movement of the worktable. By such movement the stylus can be caused to perform selected engraving operations.

The worktable employs an upper worktable member supported upon a lower worktable member with the two table members being independently moveable at right angles to one another. Movement of the two table members is effected by stepping motors or the like which may be moved at varying degrees of speed to turn power shafts for driving the work tables only a few degrees of movement or many times that amount as desired. Such motors and control means for said motors are well known in the art and form no part of this invention, per se.

The upper worktable is supported upon the lower worktable and is adapted to be driven for sliding movement thereon toward the front and rear of the marking machine and the lower worktable. A fine degree of controlled movement is effected by a rack and pinion gear drive mechanism. The pinion gear is connected to the drive shaft of the motor and is adapted to move a toothed rack engageable with the pinion gear. The rack is connected by a roller member to a traverse track connected to the upper worktable. As the rack is driven toward the front or rear of the machine the roller member bears against the track and effects a corresponding front or rear movement of the worktable. The upper worktable may simultaneously move toward the left or right in a traversing movement as the roller slides within the above described track.

The lower table is similarly adapted to be moved in a precise and variable degree of movement by a separate stepping motor. The drive shaft of the motor is connected to a toothed gear which is engageable by a toothed drive belt connected to the lower worktable. By the driving of the motor in a forward or reversed direction the toothed drive belt is positively driven toward the left or right to effect the movement of the lower worktable in a corresponding direction with a high degree of sensitivity and control.

By the aforementioned construction a workpiece such as a tag, nameplate or the like supported upon the upper worktable member can be caused to move toward the front or rear of the machine or in a traversing direction toward the left or right. Simultaneous or compound movement in an X-Y fashion may thereby be effected as desired since the two worktables may be powered independently of one another and the stylus can engrave any desired character or design subject to the control and operation of the upper and lower worktable members. Thus, conventional marking as well as engraving may be effected by the same marking machine.

The above features are objects of this invention. Further objects will appear in the detailed description which follows and will be further apparent to those skilled in the art.

For the purpose of illustration of this invention preferred embodiments thereof are shown in the accompanying drawing. It is to be understood that the drawing is for purpose of description only and that the invention is not limited thereto.

IN THE DRAWING

DESCRIPTION OF THE INVENTION

Figure 1:
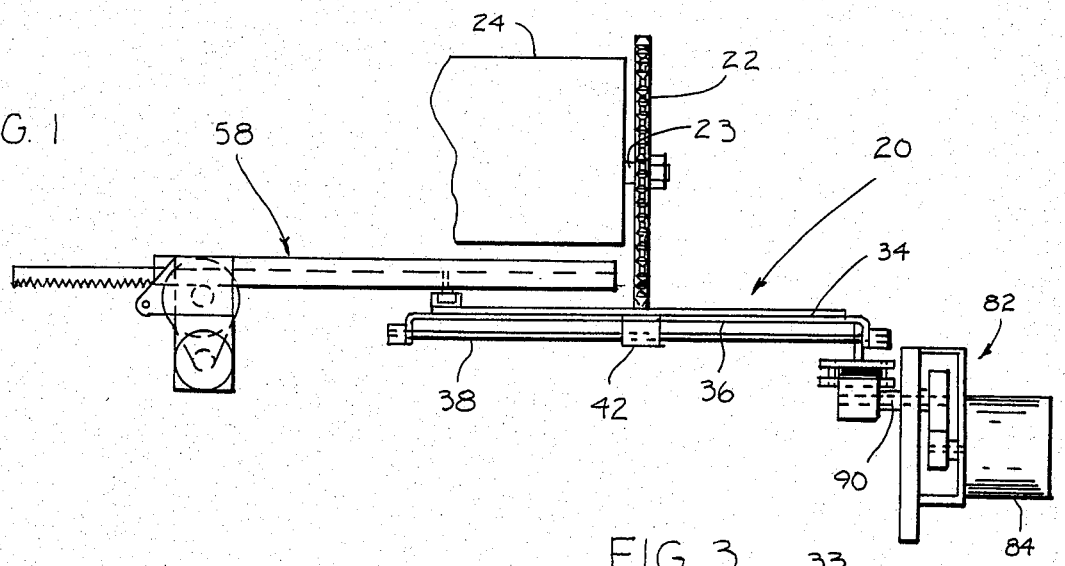
FIG. 1 is a fragmentary view of the printing wheel, the worktable and the drive portion of the machine in side elevation showing the engagement of the printing wheel with the worktable.
Figure 3:
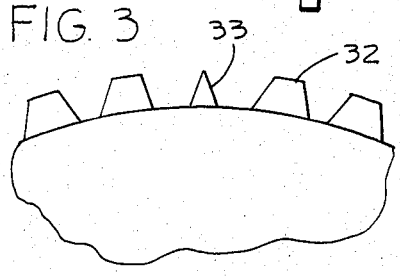
FIG. 3 is a further enlarged fragmentary view of a portion of the printing wheel showing the stylus.
Figure 2:
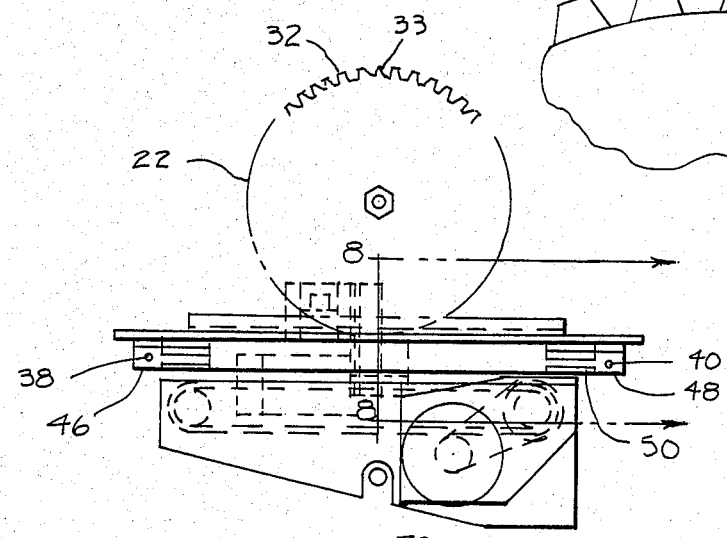
FIG. 2 is a fragmentary view similar to FIG. 1 but in front elevation.
Figure 5:
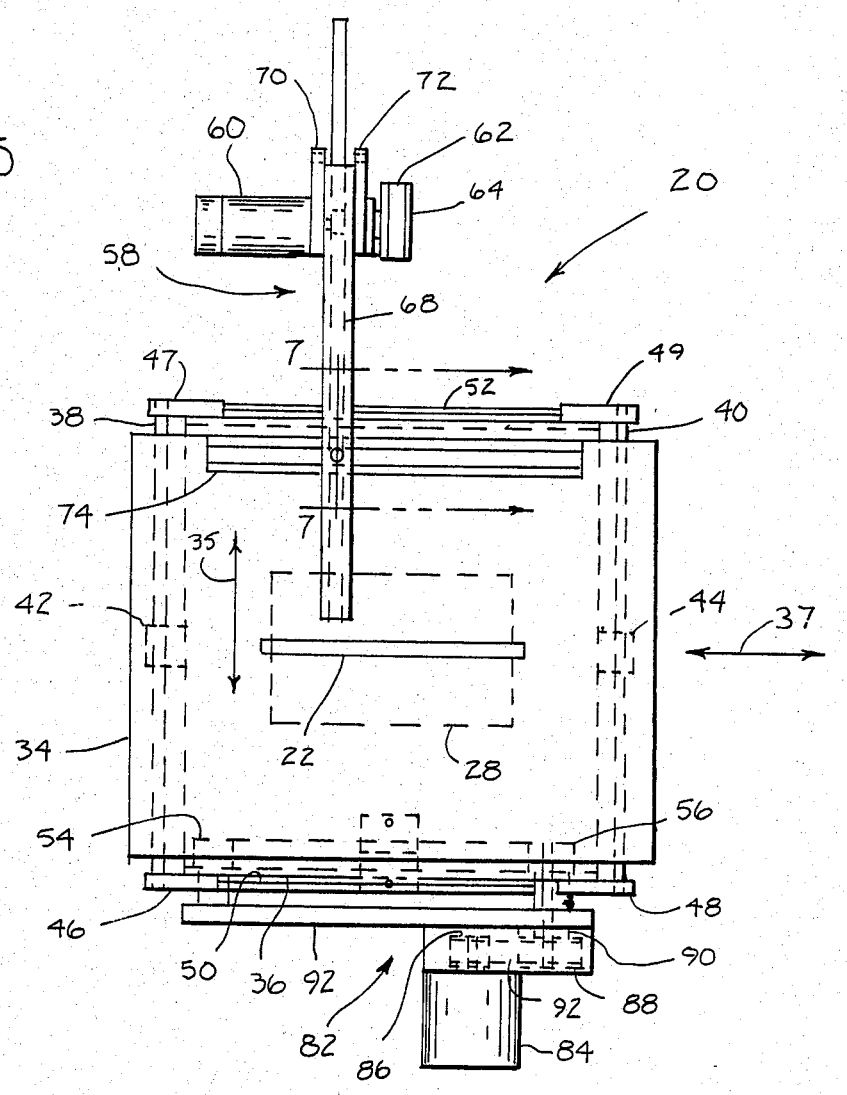
FIG. 5 is a top plan view of the table portion of the marking machine.
Figure 6:
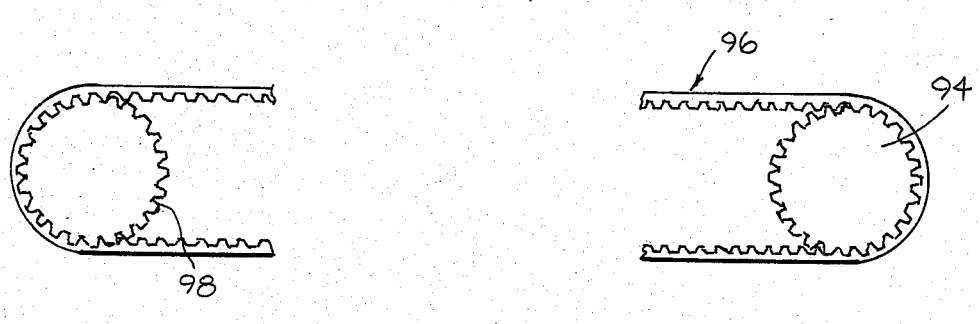
FIG. 6 is an enlarged fragmentary view in front elevation of the toothed belt drive for the lower table.
Figure 9:
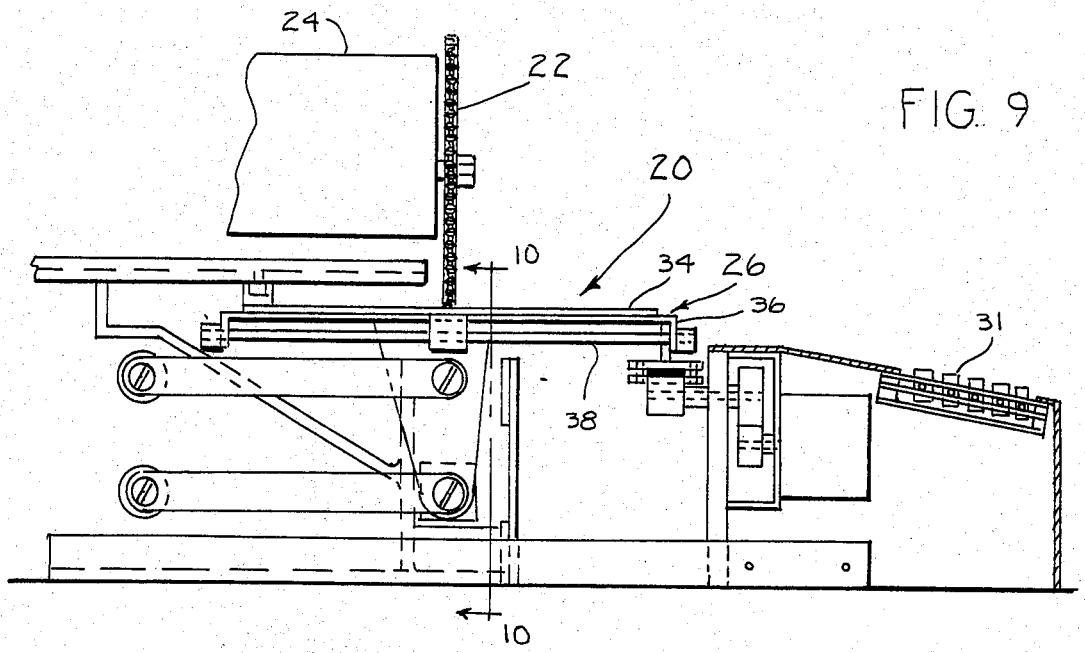
FIG. 9 is a fragmentary view in elevation partly in section taken from the left side of the machine.
Figure 10:
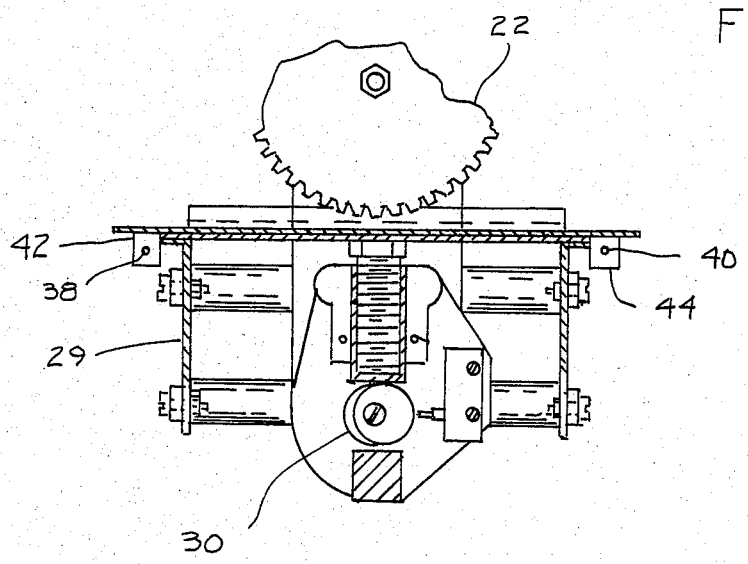
FIG. 10 is a view in section taken on the line 10—10 of FIG. 9.

The marking machine of this invention is indicated generally by the reference numeral 20 in FIGS. 1, 5 and 9. It is comprised of a rotary marking or printing wheel 22 connected by shaft 23 to a motor mount structure 24 and overlying a worktable generally indicated by the reference numeral 26 which supports a workpiece 28, such as a tag, nameplate or the like to be marked.

A support base with mechanism for raising and lowering the worktable during the marking operation and keyboard are employed as in my aforedescribed patents and may be of conventional structure. Thus, the worktable may be supported upon a carriage 29 which is raised and lowered by a thrust bar operated by a motor driven cam or eccentric 30 during the printing or marking. Appropriate circuitry may be provided between a keyboard 31 and the various components to effect the rotation and stopping of the marking wheel and the operation of the motors to drive the worktable as will be apparent in my aforesaid patents and forms no part of this invention.

The worktable 26 is adapted by this invention to move in a compound direction toward the front and rear of the invention as well as transversely to the left and right of the machine. This dual movement may be effected simultaneously to provide any type of compound movement in what may be termed an X-Y direction or sequentially as desired for character and line spacing and particularly to effect the engraving operation as will be more particularly described. This may be effected by appropriate programming from the keyboard of the stepping motors.

The marking wheel 22 is best shown in FIGS. 1, 2, 3, 9 and 10. As particularly shown in FIG. 3 it has formed on the periphery a plurality of conventional marking characters 32 and a sharp pointed stylus 33 which is employed in the engraving operation upon the workpiece.

The movement of the worktable is accomplished by providing an upper worktable member 34 upon which the workpiece 28 is supported and which may be driven in a vertical direction viewed looking down on the machine as in FIG. 5 to provide a movement along a Y axis toward the front and rear of the machine as shown by the arrow 35 in FIG. 5. The upper worktable 34 is supported upon a lower worktable 36 which is moveable to the left and right of the machine along an X axis as shown by the arrow 37.

The upper worktable 34 is slidably supported upon guide rods 38 and 40 connected to the opposite ends of the lower worktable 36 as best shown in FIGS. 1, 2, 5, 9 and 10. Bearings 42 and 44 depend from the underside of the lower worktable and receive the aforementioned guide rods. By this structure the upper worktable 34 may slidably be moved toward the front and rear of the machine in a Y direction for line spacing or fractional movement thereof in a marking or engraving operation while the lower worktable 36 and the supported upper worktable may be both moved to the left and right of the machine in a transverse X direction, simultaneously or sequentially, as will more fully appear below.

The lower worktable 36 is provided with conventional support means for supporting it for slidable transverse movement at in my U.S. Pat. No. 4,322,173. Thus, anchor blocks 46 and 48 which may be used to support the aforementioned guide rods 38 and 40 may be used to support guide rod 50 at the front of the lower worktable while similar anchor blocks 47 and 49 may be employed at the rear of the lower worktable to support the guide rod 52. Bearings 54 and 56 supported from the carriage of the machine receive the guide rod 50 and similar bearings may be provided at the rear for the guide rod 52. By this structure the lower worktable may be slidably moved transversely toward the left and right of the machine in an X direction in the desired degree of movement whether this be for character spacing, fractional movement or part of a compound movement as for an engraving operation.

Figure 4:
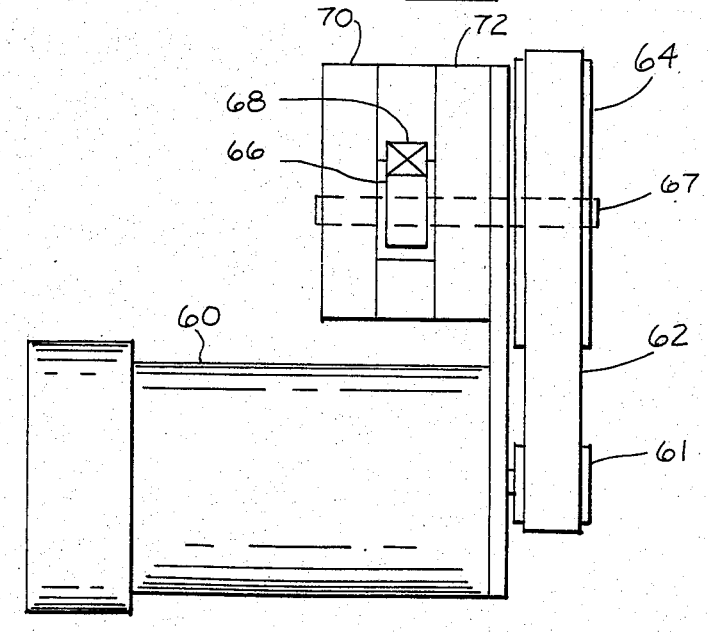
FIG. 4 is an enlarged view in front elevation showing the rack and pinion drive mechanism.
Figure 7:
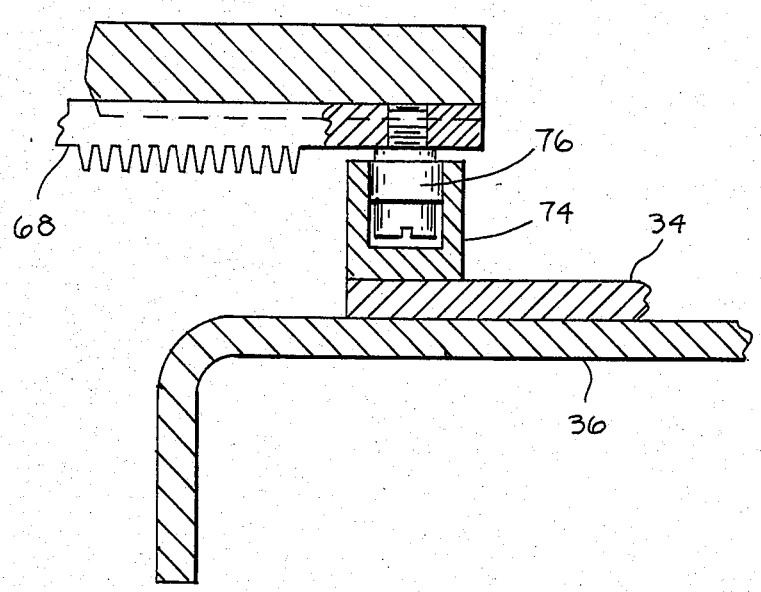
FIG. 7 is an enlarged view in section taken on the line 7—7 of FIG. 5.
Figure 8:
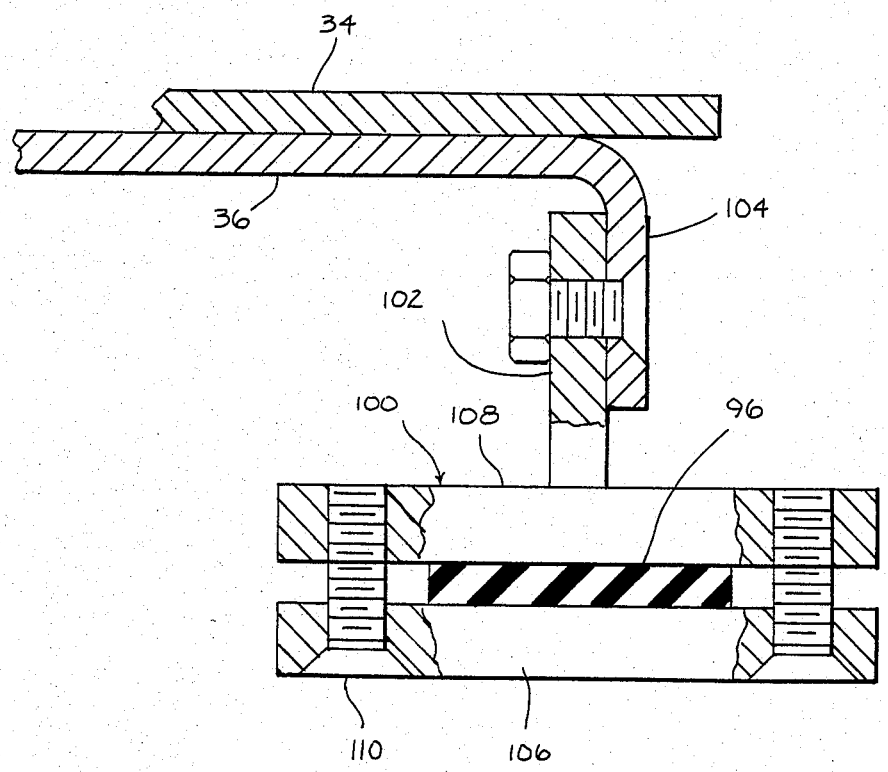
FIG. 8 is an enlarged view in section taken on line 8—8 of FIG. 2.

In order to drive the upper worktable in the vertical direction in the Y direction toward the front and rear of the maching a rack and pinion drive mechanism generally indicated by the reference numeral 58 is employed as best shown in FIGS. 1, 4, 5, 7 and 9. This mechanism is comprised of a drive motor such as a conventional stepping motor 60 having an output gear 61 connected by a toothed drive belt 62 to a gear 64. A reduced diameter pinion gear 66 is connected to the gear 64 by shaft 67 and is engaged by toothed rack 68. The rack is closely spaced to guide walls 70 and 72 as shown in FIGS. 4 and 5 above the pinion gear 66 and is supported at the forward end upon a transverse track 74 by guide roller 76 supported in depending relation at the end of the rack as best shown in FIG. 7. As the rack is moved to the front or rear it pushes or pulls the upper worktable by the bearing effect of the guide roller upon the opposed vertical walls of the track 74. The upper worktable in this movement moves along the guide rods 38 and 40 connected to the lower worktable 36. When the lower worktable is moved transversely the track, as it is supported upon the top of the upper worktable, moves correspondingly in a transverse direction and the roller connected to the rack simply rolls within the track.

The toothed belt drive means for the lower worktable 36 is best shown in FIGS. 1, 2, 5, 6, 8 and 9 and is generally indicated by the reference numeral 82. It is comprised of a stepping motor or the like 84 connected by output drive gear 86 to offset gear 88 supported on shaft 90 to a toothed drive belt 92. Shaft 90 drives gear 94 connected by second toothed drive belt 96 to an idler gear 98. A clamp 100 is clamped to the drive belt 96 and is connected by a support strut 102 to a flange 104 of the lower worktable 36.

The clamp is provided with clamp plates 106 and 108 which may be loosened and tightened by adjustment bolts 110. By this mechanism the clamp may be adjusted on selected portions of the drive belt 96 as desired.

By the aforementioned toothed belt drive mechanism the drive belt 96 can be caused to move to the left and right in a transverse X direction relative to the machine and responsive to the energization of the motor. As the drive belt mechanism is moved the lower worktable which is clamped to the drive belt moves in a corresponding direction. Slippage is avoided through the use of the toothed gears which act as pulleys for the toothed drive belts. The drive mechanism provides a positive response from the motor energization to the lower worktable and as the lower worktable is moved the upper worktable which is supported upon it and which carries the workpiece moves to the left or right in a transverse X direction and is free at the same time to move toward the front or rear of the machine in a Y direction. Simultaneous movement in both the X and Y directions is made possible to provide any type of a compound movement for carrying out an engraving operation with the stylus 33.

Figure 11:
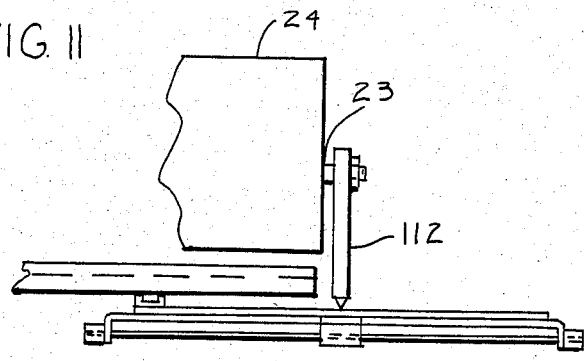
FIG. 11 is a fragmentary view in side elevation showing an engraving stylus used on the machine in lieu of the printing wheel.
Figure 12:
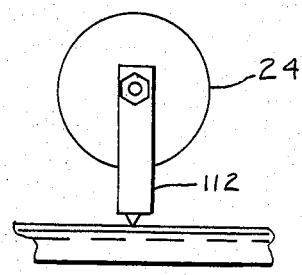
FIG. 12 is a fragmentary view in front elevation of the engraving stylus of FIG. 11.

In lieu of the marking wheel having marking characters 32 and a stylus 33 on the periphery of the wheel a separate stylus 112 as shown in FIGS. 11 and 12 may be employed for the engraving operation. The stylus may be simply mounted on the motor shaft 23 in lieu of the marking wheel.

Figure 13:
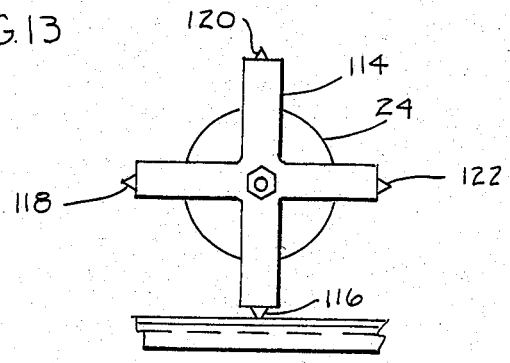
FIG. 13 is a fragmentary view in front elevation of the machine with a modified X-shaped support for a multiple stylus.

The separate stylus may also be provided in the modified form shown in FIG. 13 of an X-shaped web support 114 supporting four separate styluses 116, 118, 120 and 122 which may be of any desired design or the same to present a fresh sharp stylus when needed.

Figure 14:
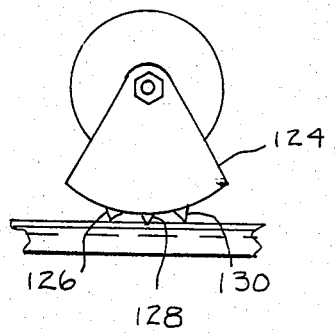
FIG. 14 is a fragmentary view in front elevation of the machine with a modified arc segment supporting a multiple stylus.

A further modified support 124 is shown in FIG. 14 in the form of a pie shaped wheel segment supporting three styluses 126, 128 and 130. It will be appreciated that the wheel segment may be increased to a semi-circle or full wheel with as many separate styluses as desired.

Figure 15:
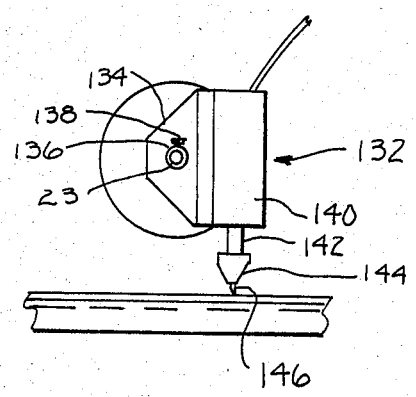
FIG. 15 is a fragmentary view in front elevation of the machine with a modified rotary engraving tool.

A rotary engraving tool modification rather than the stylus or scratch engraving is shown in FIG. 15. In this embodiment a self contained motorized engraving unit 132 is provided with an attachment plate 134 having a flanged opening 136 which fits over the machine shaft 23 and is tightened thereto by a set screw 138.

The motorized engraving unit is of conventional construction and, per se, forms no part of this invention. It is provided with a motor 140 having an output shaft 142 connected to a collet 144 which receives a conventional sharp edge pointed rotary cutting tool 146 which is used to perform the engraving operation. Power may be supplied through the electric cord. It will be understood that the electrical motor to supply the rotary power is exemplary and that air motor or pulley connected to a rotary power source may be employed as desired.

OPERATION

The marking machine may be employed in the same manner as conventional marking machines and as described in my aforementioned patents. Thus, the keyboard 31 may be employed to cause the upper and lower worktable to move in a selected manner to present the workpiece 28 in the desired location under the marking wheel to stop the wheel and raise the upper and lower worktables 34 and 36 to contact the workpiece 28 with the marking wheel to effect the desired marking by contact with any of the marking characters 32 or by contacting the stylus 33 to effect an engraving operation. The separate styluses 112, 114 and 124 shown in FIGS. 12, 13, 14 and 15 are employed in a like manner as stylus 33. The engraving may be in the form of stylizing letters of any selected pattern or designs of one type or another as is well known in the art and is carried out by appropriate control of the stepping motors to effect the compound X-Y movement in the desired fashion.

The work table and the supported workpiece may be moved within the limits of movement upon the various supporting guide rods in any type of simultaneous X-Y compound movement depending upon the speed and direction of rotation of the rack and pinion drive motor 60 for the upper worktable 34 and the toothed belt drive motor 84 which drives the lower worktable 34.

The movement of the upper worktable 34 is responsive to the movement of the rack 68 driven by the motor 60 and through the engagement of the roller 76 supported at one forward end of the rack causes the upper worktable to move toward the front or rear of the machine in a vertical or Y direction along the top of the lower worktable 36. This movement is along the guide rods 38 and 40 and may be carried out whether the lower worktable is stationary or moving in a transverse left or right X direction. The simultaneous X-Y movement is made possible since the roller 76 is confined within the track 74 and may bear against either of the side walls of the track while the track itself is moving responsive to the movement of the lower worktable 36 which supports both the upper worktable and the track.

Movement of the lower worktable 36 is effected by the energization of the drive motor which through its drive mechanism causes the clamped toothed drive belt 96 to move toward the left and right of the machine in a traverse or X direction. The movement of the lower worktable responsive to the aforesaid toothed drive belt movement is along the support guide rods 50 and 52. Since the upper worktable 34 is supported upon and carried by the lower worktable 36 the workpiece 28 is moved correspondingly with the aforementioned movement of the lower worktable.

The movement provided by the rack and pinion drive structure for the upper worktable and the clamped toothed belt drive structure for the lower worktable makes possible a wide variation of any type of incremental and X-Y movement desired. The movement is effected in a positive manner without slippage and can be effectively employed for a wide range of desired marking and engraving operations.

Various changes and modifications may be made within this invention as will be apparent to those skilled in the art. Such changes and modifications are within the scope and teaching of this invention as defined in the claims appended hereto.

What is claimed is:

1. A marking machine provided with a rotatable horizontally extending shaft having means for receiving selectively a vertically disposed rotatable marking wheel or separate engraving tool adapted to be engaged in marking contact with a workpiece supportable upon an underlying worktable, said marking wheel being provided with marking characters such as letters, numerals and the like and an engraving tool for engraving characters, designs and the like on the periphery of the wheel, said marking wheel or separate engraving tool and worktable being adapted to be engaged together to bring the marking wheel or separate engraving tool and workpiece together in marking engagement and means for driving said worktable in an X-Y relation to provide said engraving by the marking wheel or the separae engraving tool, said means comprising providing said worktable with an upper worktable member supportable upon a lower worktable member for slidable movement to the front and rear thereof in a Y direction, means for driving the lower worktable member with the upper worktable member supported therein in a transversing X direction to the left and right of the machine, means for driving the upper worktable member in said Y direction reciprocably toward the front and rear of the machine, said means for driving the upper worktable and said means for driving the lower worktable being independent of each other and being simultaneously operable at different rates of speed, said marking wheel or separate engraving tool being rotatable to a selected marking or engraving position in registry with said workpiece and means for raising the worktable and supported workpiece into marking or engraving engagement with said marking wheel or separate engraving tool.

2. The marking machine of claim 1 in which a stepping motor is employed for both the means for driving the upper worktable and the means for driving the lower worktable.

3. The marking machine of claim 1 in which the means for driving the upper worktable comprises a motor driven pinion gear engageable with a toothed rack for driving said rack reciprocably toward the front and rear of the machine and said means for driving the lower worktable member comprises a motor driven pinion gear engageable with a toothed drive belt for driving said lower worktable member in a traversing direction to the left and right of the machine.

4. The marking machine of claim 3 in which said rack is engageable with said upper worktable to effect a frontward and rearward driving relation and said drive belt has means for connecting it to said lower worktable member to effect said driving relation.

5. The marking machine of claim 3 in which a stepping motor is employed for both the means for driving the upper worktable and the means for driving the lower worktable.

6. The marking machine of claim 3 in which separate stepping motors are provided for driving the pinion gears for the upper and lower worktable members.

7. The marking machine of claim 1 in which the marking wheel is maintained stationary with the engraving tool in engagement with the workpiece while the worktable is moved in an X-Y relation to provide a desired engraving upon the workpiece.

8. The marking machine of claim 1 in which the marking wheel is maintained stationary with the engraving tool in engagement with the workpiece while the worktable is moved in an X-Y relation to provide a desired engraving upon the workpiece, said marking wheel being rotatable to a selected marking position in registry with said workpiece and means are provided for raising the worktable and supported workpiece into marking engagement with said marking wheel.

9. The marking machine of claim 1 in which a stepping motor is employed for both the means for driving the upper worktable and the means for driving the lower worktable and the marking wheel is maintained stationary with the engraving tool in engagement with the workpiece while the worktable is moved in an X-Y relation to provide a desired engraving upon the workpiece, said marking wheel is rotatable to a selected marking position in registry with said workpiece and means are provided for raising the worktable and supported workpiece into marking engagement with said marking wheel.

10. The marking machine of claim 1 in which a marking wheel is employed, said marking wheel being provided with marking characters such as letter, numerals and the like on the periphery of the wheel and an engraving tool on the periphery of the wheel for engraving characters, designs and the like.

11. The marking machine of claim 1 in which said separate engraving tool is employed.

12. The marking machine of claim 11 in which a plurality of different engraving tools in the form of styluses are supported upon said machine, said styluses being rotatable upon said machine to present a selected stylus for engagement with said workpiece.

13. The marking machine of claim 1 in which stepping motor means are provided to move said worktable in an X-Y direction while the engraving tool is maintained in engraving relation with said workpiece.

14. The marking machine of claim 13 in which said worktable is provided with an upper worktable member and means for driving it upon a supporting member in a reversible linear direction and means for simultaneously driving said supporting member in a reversible perpendicular or rectilinear direction to that of the upper worktable member to provide said X-Y direction of movement.

15. A marking machine provided with a rotatable horizontally extending shaft having means for receiving selectively a vertically disposed rotatable marking wheel or separate engraving tool adapted to be engaged in marking contact with a workpiece supportable upon an underlying worktable, said marking wheel being provided with marking characters such as letters, numerals and the like and an engraving tool for engraving characters, designs, and the like on the periphery of the wheel, said marking wheel or separate engraving tool and worktable being adapted to be engaged together to bring the marking wheel or separate engraving tool and workpiece together in marking engagement, means for driving said worktable in an X-Y relation to provide said engraving by the marking wheel or the separate engraving tool, said marking wheel being maintained stationary with the engraving tool in engagement with the workpiece while the worktable is moved in an X-Y relation to provide a desired engraving upon the workpiece, said marking wheel or separate engraving tool being rotatable to a selected marking or engraving position in registry with said workpiece and means for raising the worktable and supported workpiece into marking or engraving engagement with said marking wheel or separate engraving tool.

16. The marking machine of claim 15 in which a marking wheel is employed, said marking wheel being provided with marking characters such as letters, numerals and the like on the periphery of the wheel and an engraving tool in the form of a stylus on the periphery of the wheel for engraving characters, designs and the like.

17. The marking machine of claim 15 in which said separate engraving tool is employed.

18. The marking machine of claim 17 in which means are provided for supporting a plurality of different engraving tools in the form of a stylus upon said machine, said means being rotatable upon said machine to present a selected stylus for engagement with said workpiece.

19. The marking machine of claim 17 in which said separate engraving tool is in the form of a sharp edged rotary engraving tool and means are provided for imparting rotary power thereto.

20. The marking machine of claim 17 in which means are provided for mounting said separate engraving tool to said horizontally extending rotatable shaft of the marking machine having means for supporting interchangeably said marking wheel and said separate engraving tool.

* * * * *